US009126378B2

(12) United States Patent
Ito et al.

(10) Patent No.: US 9,126,378 B2
(45) Date of Patent: Sep. 8, 2015

(54) SERVO PRESS APPARATUS DRIVEN BY MULTIPLE MOTORS

(75) Inventors: Takao Ito, Kanagawa (JP); Takashi Koshimizu, Kanagawa (JP); Hiroshi Nagase, Kanagawa (JP)

(73) Assignee: AIDA ENGINEERING, LTD., Kanagawa (JP)

( * ) Notice: Subject to any disclaimer, the term of this patent is extended or adjusted under 35 U.S.C. 154(b) by 409 days.

(21) Appl. No.: 13/042,752

(22) Filed: Mar. 8, 2011

(65) Prior Publication Data

US 2011/0290125 A1 Dec. 1, 2011

(30) Foreign Application Priority Data

May 28, 2010 (JP) ..... 2010-122998

(51) Int. Cl.
*B30B 1/06* (2006.01)
*B30B 1/26* (2006.01)

(52) U.S. Cl.
CPC ..... *B30B 1/266* (2013.01)

(58) Field of Classification Search
CPC ..... B30B 1/266
USPC ..... 72/452.5, 453.02, 453.04, 449, 454; 100/285, 286, 282, 283, 284, 214, 242, 100/43; 74/49; 310/112
See application file for complete search history.

(56) References Cited

U.S. PATENT DOCUMENTS 4,020,671 A * 5/1977 Oberheim et al. ..... 72/450
4,614,099 A * 9/1986 Coulter ..... 72/29.1
4,785,213 A * 11/1988 Satake ..... 310/116
5,365,137 A * 11/1994 Richardson et al. ... 310/216.039
5,832,816 A * 11/1998 Seto et al. ..... 100/48
6,034,456 A * 3/2000 Osama et al. ..... 310/90.5
6,737,778 B2 * 5/2004 Daikoku et al. ..... 310/112
7,102,316 B2 * 9/2006 Beyer et al. ..... 318/625
7,475,584 B2 * 1/2009 Naito et al. ..... 72/443
2002/0113511 A1 * 8/2002 Daikoku et al. ..... 310/112
2009/0260460 A1 * 10/2009 Darr et al. ..... 74/49
2011/0126649 A1 * 6/2011 Darr ..... 74/44
2012/0133227 A1 * 5/2012 Boskovitch ..... 310/112

FOREIGN PATENT DOCUMENTS

JP 62-071495 A 4/1987
JP 2001-062596 A 3/2001

(Continued)

OTHER PUBLICATIONS

United States Office Action issued in U.S. Appl. No. 13/114,202 dated Sep. 30, 2013.

(Continued)

*Primary Examiner* — Shelley Self
*Assistant Examiner* — Leonel Vasquez
(74) *Attorney, Agent, or Firm* — McDermott Will & Emery LLP

(57) ABSTRACT

This invention is intended to provide a large-capacity servo press apparatus driven by multiple motors, the servo press apparatus enabling a drive at a high efficiency and with reduced torque pulsations in a simple structure. The disclosed servo press comprises a slide that is moved up and down by a plurality of crank structures (including eccentric rings and connecting rods), main gears that drive the crank structures, a plurality of drive gears interlinked with the main gears directly or indirectly, intermediate gears interlinked with the main gears directly or indirectly, and servo motor sets connected to drive shafts to drive the drive gears. In each of the servo motor sets, a plurality of servo motors are directly connected to each servo motor shaft.

15 Claims, 7 Drawing Sheets

(56) References Cited

FOREIGN PATENT DOCUMENTS

| | | | |
|---|---|---|---|
| JP | 2001-062596 | A | 3/2001 |
| JP | 2004-017089 | A | 1/2004 |
| JP | 2004-017089 | A | 1/2004 |
| JP | 2005-271070 | A | 10/2005 |

OTHER PUBLICATIONS

Japanese Office Action issued in Japanese Application No. 2010-122998 dated Oct. 9, 2012.

* cited by examiner

SERVO PRESS APPARATUS DRIVEN BY MULTIPLE MOTORS

CROSS REFERENCE TO RELATED APPLICATIONS

The present application claims priority under 35 U.S.C. §119 to Japanese Patent Application No. 2010-122998, filed May 28, 2010, which is incorporated herein by reference.

FIELD OF THE INVENTION

The present invention relates to a large-scale servo press apparatus, particularly, a large-capacity servo press apparatus driven by multiple servo motors.

BACKGROUND OF THE INVENTION

Servo press machines driven by a servo motor are capable of a variety of slide motions. Therefore, the servo press machines are useful, for example, for facilitating a drawing operation by slowing down immediately before a press load is applied, or for noise reduction, or for productivity improvement by a so-called pendulum motion, i.e., up and down movement of a slide near the bottom of the stroke of the slide. A large-scale servo press apparatus uses a multipoint drive in which the force is applied to multiple points on the slide. Due to this, a servo motor to drive the press is required to be larger and have a larger capacity. In consequence, it is adopted to drive the press with multiple motors. A large-capacity servo press driven by multiple motors can be realized.

SUMMARY OF THE INVENTION

According to Japanese Laid-Open Patent Application No. 2004-17089, contrivance that enables a large-scale press with two motors is described. However, this document does not specify how motors are arranged for a larger scale press for which the capacity of the two motors becomes insufficient. According to Japanese Laid-Open Patent Application No. 2001-62596, contrivance that enables a larger-scale press by increasing the number of motors placed on a crankshaft is described. However, a motor that directly drives a crankshaft is required to yield very much torque and there is a problem of enlarging the motor itself.

Further, according to Specification of U.S. Pat. No. 7,102,316, contrivance that enables a larger-scale press by using four motors is described. However, one problem hereof is a complicated press structure in which the motors' torques are transmitted via gears attached to the respective motors. Another problem is an increase in loss due to the fact that the force is applied to multiple points on the slide and gears to drive the force applied points are interlinked using intermediate gears. A point that is not taken into account in all of the above-mentioned patent documents is reducing torque pulsations generated by the respective motors, thereby enhancing a drive. Therefore, a problem may be encountered in terms of accuracy of positioning the slide, responsiveness, and noise.

The present invention has been made to address the above-noted problems and is intended to provide a large-capacity servo press apparatus driven by multiple motors, the servo press apparatus enabling a drive at a high efficiency and with reduced torque pulsations in a simple structure.

In a servo press having a plurality of servo motor shafts, the present invention realizes a large-capacity servo press by placing a plurality of servo motors directly on each of the servo motor shafts.

More specifically, a first aspect of the present invention resides in a servo press apparatus driven by multiple motors, the servo press comprising a slide that is moved up and down by a plurality of crank structures, a gear train that interconnects the crank structures directly or indirectly, and a plurality of servomotor shafts connected to the gear train, wherein a plurality of servo motors are directly placed on each of the servo motor shafts.

A second aspect of the present invention resides in the servo press apparatus driven by multiple motors according to the first aspect, wherein the crank structures are connected to main gears, the main gears are interlinked with drive gears connected to the servo motor shafts, and the main gears are interconnected directly or via intermediate gears.

A third aspect of the present invention resides in the servo press apparatus driven by multiple motors according to the first aspect, wherein the crank structures are connected to main gears, the main gears are interlinked via intermediate gears with drive gears connected to the servo motor shafts, and the main gears are interconnected directly or via intermediate gears.

A fourth aspect of the present invention resides in the servo press apparatus driven by multiple motors according to any of the first through third aspects, wherein a plurality of servo motors are placed on a servo motor shaft such that the servo motors are arranged on either side and/or one side of a drive gear placed on the servo motor shaft connected to the gear train.

A fifth aspect of the present invention resides in the servo press apparatus driven by multiple motors according to any of the first through third aspects, wherein a plurality of servo motors are placed on a servo motor shaft such that the servo motors are arranged in a tandem structure within a same frame.

A sixth aspect of the present invention resides in the servo press apparatus driven by multiple motors according to any of the first through fifth aspects, wherein a plurality of servo motors are placed on a servo motor shaft such that the phases of the servomotors differ from one another with respect to the axis of rotation in order to cancel out mutual torque pulsations of the motors.

A seventh aspect of the present invention resides in the servo press apparatus driven by multiple motors according to any of the first through sixth aspects, wherein an encoder is attached to each of the servo motor shafts and a plurality of servomotors placed on one of the servomotor shafts are controlled by the encoder attached to the servo motor shaft.

An eighth aspect of the present invention resides in the servo press apparatus driven by multiple motors according to the seventh aspect, wherein one of the servomotor shafts is regarded as a master shaft and control of a plurality of servo motors is implemented.

According to the first, second, and third aspects of the present invention, the servo press apparatus, in which a plurality of motors are placed on a same drive shaft, provides for complete synchronization of the right and left crank structures by means of the gear train and enables a drive with fewer gears. Thus, the servo press apparatus provides the following advantages: simple structure; small loss; downscalable; highly-responsive operation with small inertia moment is practicable; impervious to accuracy deterioration due to gear backlash; and less gear duty, as a sum of torques produced by a set of motors is only exerted on each gear.

According to the fourth aspect of the present invention, in addition to the above-noted advantages, because the servo motor shafts can be made shorter, the servo press apparatus provides a further advantage in which it can be further downscaled.

According to the fifth aspect of the present invention, in addition to the above-noted advantages, because the servo motor shafts can be made even shorter, the servo press apparatus provides a further advantage in which it can be even more downscaled.

According to the sixth aspect of the present invention, in addition to the above-noted advantages, the servo press apparatus provides a further advantage in which operation with reduced torque pulsations can be performed.

According to the seventh aspect of the present invention, in addition to the above-noted advantages, because the number of encoders can be decreased, the servo press apparatus provides a further advantage in which a drive with a high reliability can be achieved.

Moreover, according to the eighth aspect of the present invention, in addition to the above-noted advantages, the servo press apparatus provides a further advantage in which a well-balanced operation between or among a plurality of motors can be accomplished.

DETAILED DESCRIPTION OF THE PREFERRED EMBODIMENTS

Embodiments of the present invention will be described hereinafter by means of FIGS. 1 through 12.

[First Embodiment]

Figure 1:
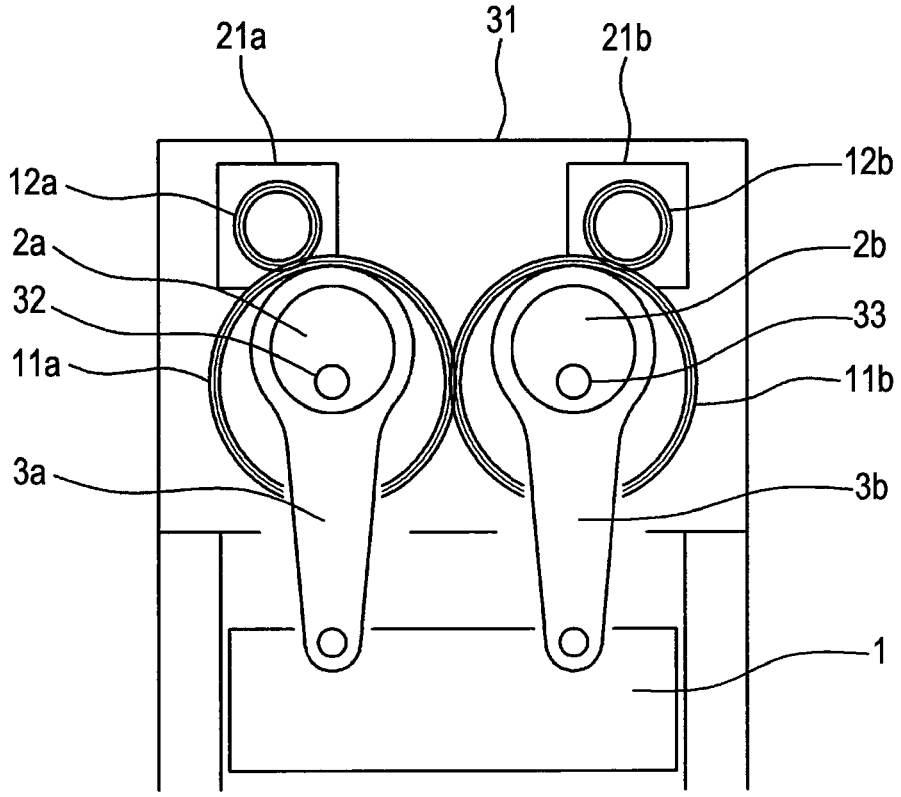
FIG. 1 is a structural diagram of a first embodiment of the present invention.
Figure 2:
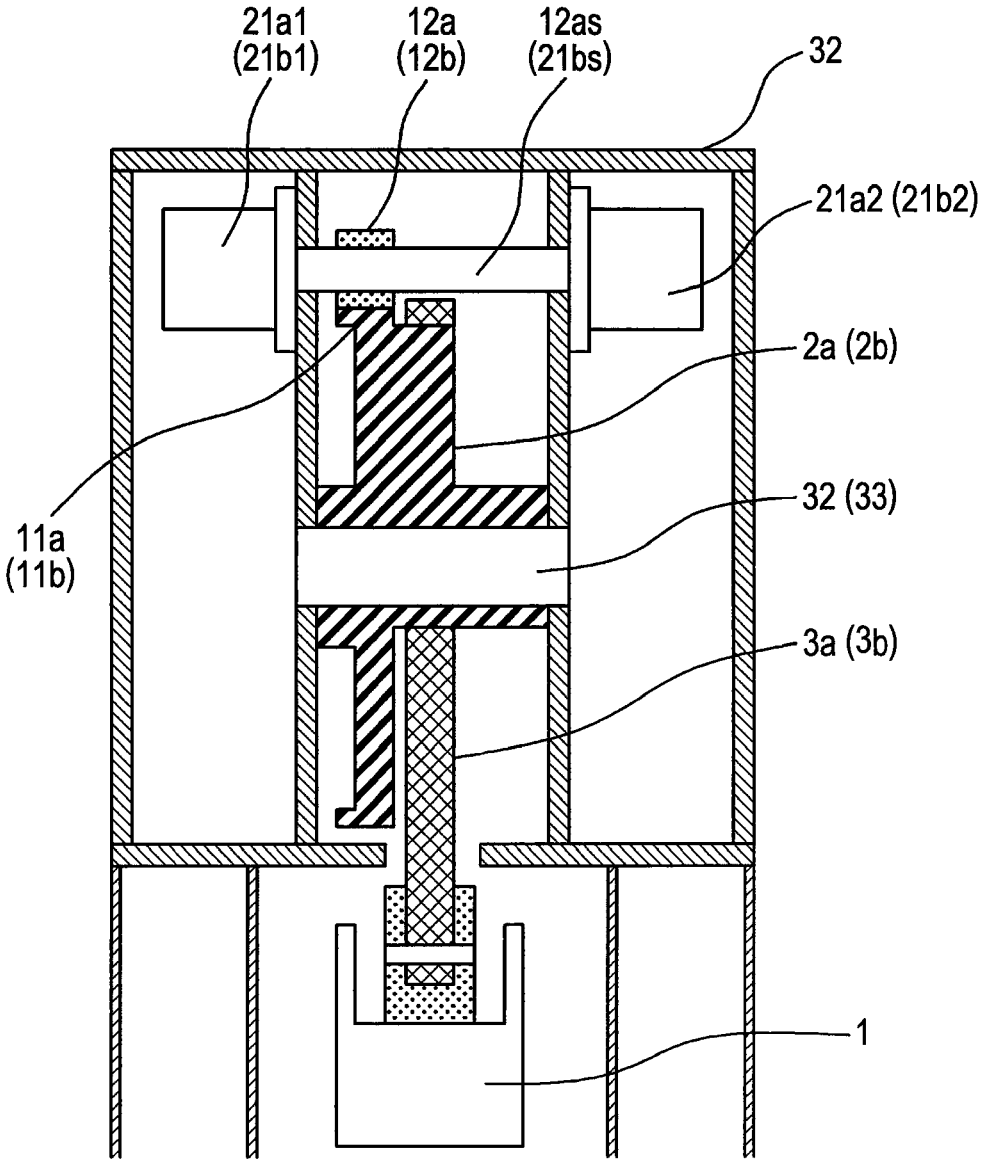
FIG. 2 is a transverse sectional view of the first embodiment of the present invention.

FIGS. 1, 2, and 3A to 3D illustrate a press apparatus of a first embodiment of the present invention. These figures schematically represent only an operating section pertaining to the present invention. FIG. 1 is a structural diagram as viewed from front. FIG. 2 is a transverse sectional view. FIGS. 3A, 3B, 3C, 3D illustrate arrangements of motors as viewed from a top plane. The press has a structure of an eccentric press.

First, the structure is described with reference to FIGS. 1 and 2. A set of servomotors (servo motor set) 21*a* is installed in the servo press apparatus's frame 31. An output shaft of the servo motor set 21*a* is connected to a drive shaft 21*as* which is directly connected thereto. A plurality of servo motors is connected to the motor output shaft or the drive shaft. Herein, this set of the servo motors is referred to as a servo motor set. A drive gear 12*a* is provided on the drive shaft 21*as*. A pin 32 is provided in the frame 31. Both ends of the pin 32 are fixed to the frame 31.

An eccentric ring 2*a* engages with the pin 32. Amain gear 11*a* is fixed to the eccentric ring 2*a*. The main gear 11*a* meshes with the drive gear 12*a*.

The eccentric ring 2*a* rotates together with the main gear 11*a*. An eccentric portion of the eccentric ring 2*a* engages with a hole in a large-diameter portion of a connecting rod 3*a*. A lower end of the connecting rod 3*a* is connected to a slide 1.

A servo motor set 21*b* is also installed in the servo press apparatus's frame 31. An output shaft of the servo motor set 21*b* is connected to a drive shaft 21*bs*. A drive gear 12*b* is provided on the drive shaft 21*bs*. A pin 33 is provided in the frame 31. Both ends of the pin 33 are fixed to the frame 31.

An eccentric ring 2*b* engages with the pin 33. A main gear 11*b* is fixed to the eccentric ring 2*b*. The main gear 11*b* meshes with the drive gear 12*b*. The eccentric ring 2*b* rotates together with the main gear 11*b*. An eccentric portion of the eccentric ring 2*b* engages with a hole in a large-diameter portion of a connecting rod 3*b*. A lower end of the connecting rod 3*b* is connected to the slide 1. The main gears 11*a* and 11*b* mesh with each other.

The slide 1 is moved up and down by a crank mechanism comprised of the eccentric ring 2*a* and the connecting rod 3*a* and a crank mechanism comprised of the eccentric ring 2*b* and the connecting rod 3*b*. That is, the slide 1 is moved up and down by a crank structure and by the aid of rotation of the main gears 11*a* and 11*b*.

Torque of the servo motor set 21*a* is directly transmitted to the main gear 11*a*, whereas torque of the servo motor set 21*b* is directly transmitted to the main gear 11*b*. In the present embodiment, no additional gear is provided in order to synchronize the main gears. The structure as described above provides for synchronization of the right and left main gears 11*a* and 11*b* , that is, synchronously moving up and down of the force applied points on the slide.

For the servo motor sets 21*a*, 21*b* , in either case, a plurality of servo motors are connected to a same shaft. The sectional view of FIG. 2 depicts the structure in which the motors are arranged as in FIG. 3A, which will be described later.

The crank mechanisms are rotationally driven freely by controlling the normal rotation, reverse rotation and variable speeds of the servo motor sets 21*a*, 21*b* . Thus, it is possible to flexibly set a variety of slide motions such as slide motions other than the crank mechanisms, accelerated and decelerated motions including standstill suitable for a molding method, or normal reverse pendulum motion. These motions can be used in any combination or switching from one motion to another can take place. Consequently, it is possible to improve the molding accuracy for press molded products and expand the productivity and adaptivity. As the motors in the servo motor sets 21*a*, 21*b* , synchronous motors using a permanent magnet, synchronous motors using a wound field, induction motors, reluctance motors, etc. can be utilized.

Additionally, instead of these AC motors, DC motors may be used. Herein, this embodiment is described on the assumption that the motors in the servo motor sets 21*a*, 21*b* are permanent magnet synchronous motors. Although FIG. 1 shows the eccentric press which is taken as an example, an alternative may be a crank press apparatus having crankshafts to move the slide up and down. Further, this embodiment may also be applied to presses by means of other mechanisms such as a link press and a knuckle press without the crank structure. In the present invention, the entire structure as described above by which the slide is moved up and down is referred to as a crank structure (claim 1). Although two connecting rods 3*a*, 3*b* are shown, the press apparatus may alternatively be provided with more than two connecting rods.

FIGS. 3A, 3B, 3C, and 3D present examples of concrete arrangements of servo motors connected in the servo motor sets. In these figures, the same reference numbers denote the same components as in FIG. 1 and FIG. 2.

Figure 3A:
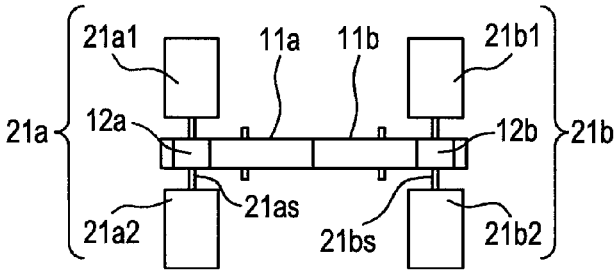
FIGS. 3A, 3B, 3C, and 3D illustrate arrangements of motors according to the first embodiment of the present invention.
Figure 3B:
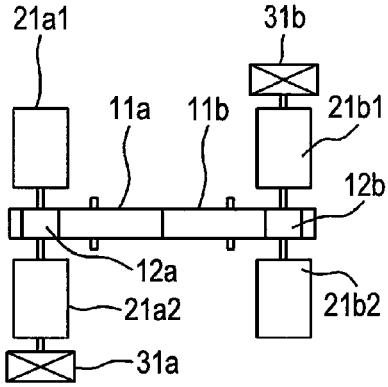
Figure 3C:
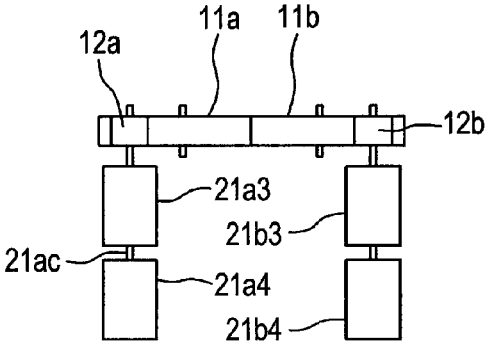

For the servo motor set 21*a* in FIGS. 3A, 3B, and 3C, two servo motors are connected to a same output shaft 21*ac* or drive shaft 21*as* . A way of connecting the motors will be described later. For the servo motor set 21*b*, similarly, two servo motors are connected to a same output shaft 21*bc* or drive shaft 2l*bs*.

Figure 3D:
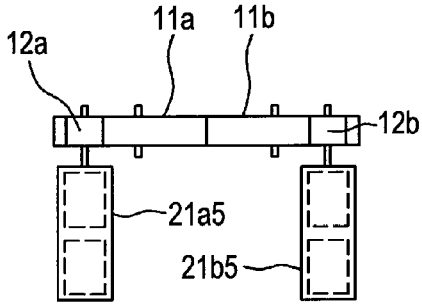

FIGS. 3A and 3B present examples wherein motors are arranged on either side of the drive gears 12*a*,12*b*. In particular, servo motors 21*a*1, 21*a*2 are connected on either side of the drive gear 12*a* and servo motors 21*b*1, 21*b* 2 are connected on either side of the drive gear 12*b*. The drive shaft is short and, thereby, a well-balanced drive can be yielded. FIG. 3B presents an arrangement example wherein mechanical brake devices 31*a*, 31*b* are added to the motor arrangement as in FIG. 3A. A brake device is attached to a non-load end of one servo motor in each motor set. FIG. 3C presents an example wherein motors 21*a*3, 21*a*4 are arranged on one side of the drive gear 12*a* and motors 21*b*3, 21*b* are arranged on one side of the drive gear 12*b* and this arrangement can make the drive shafts of the motors even shorter. FIG. 3D presents an example wherein a stator part and a rotor part (surrounded by broken lines in the figure) of a plurality of motors are contained within a same frame. Motors 21*a*5 and 21*b*5 are arranged in a so-called tandem structure. As shown, each drive gear is apparently driven by a single motor. In such a structure, the motor connections are short and the space for the motors can be made even smaller.

While FIGS. 3A, 3B, 3C, and 3D present the examples wherein two motors are connected to a same drive shaft, the number of motors may be three or more, according to the power of one motor or the power required to drive the press apparatus.

In a case where additional motors are needed in consideration of the capacity required for the press apparatus, an alternative method with regard to FIG. 1 is to increase the number of drive shafts of servo motors to drive one main gear. Specifically, for example, in addition to the drive gear 12*a* that meshes with the main gear 11*a*, another drive gear may be provided and a plurality of servo motors may be placed on this shaft.

The brake devices are used to keep the slide stopped or for emergency stop of the slide. As for their arrangement, in the example of FIG. 3B, a brake device 31*a* is attached to a non-load end of a servo motor 21*a*2 and a brake device 31*b* is attached to a non-load end of a servo motor 21*b*1. The brake devices maybe arranged alternatively. For example, the brake device 31*a* may be attached to a non-load end of a servo motor 21*a*1. In consideration of the capabilities of the brakes, brake devices may be attached to all the non-load ends of servo motors 21*a*1, 21*a*2, 21*b*1, 21*b*2, respectively. Further, a special gear for brake use is disposed in conjunction with the main gears 11*a* and 11*b* and a brake device may be placed on the shaft of this gear. Alternatively, a brake device may be placed on a shaft connecting with the main gears. The presented arrangement of the brake devices can be considered to be provided in the same way with regard to FIGS. 3C and 3D. For example, in FIG. 3C, the brake devices may be disposed symmetrically with the motor arrangement with respect to each drive gear. That is, the brake devices may be attached to the drive shaft ends to which no motors are connected, as viewed from the drive gears.

Figure 4:
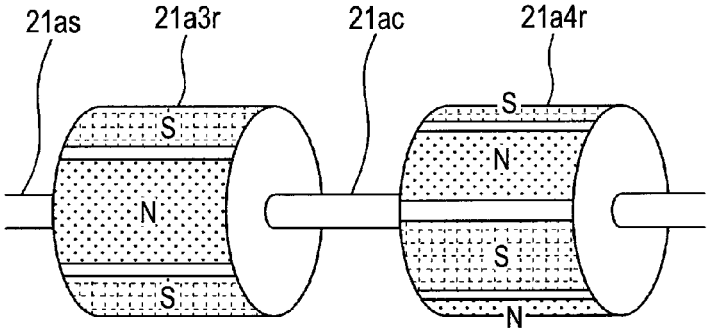
FIG. 4 is a diagram illustrating how the motors are connected according to the first embodiment of the present invention.

Then, descriptions are provided for a way of connecting the plurality of servo motors, which is a feature of the present invention. In permanent magnetic servo motors, torque pulsations depending on rotational positions of the motors take place, such as cogging torque attributed to a magnetic circuit structure or torque pulsation due to a waveform of an armature current. Smaller toque pulsations are desirable, because the torque pulsations cause deterioration in the accuracy of positioning the slide, a decrease in responsiveness or noise during driving. In the present invention, because a plurality of motors is connected to a same shaft, the motors can be connected to cancel out the torque pulsations generated by each motor. Specifically, in a case where the motors are arranged as in FIG. 3C, when two servo motors are connected to a same output shaft 21*ac*, they are connected in rotational positions in which the phases of the torque pulsations generated by the two servo motors 21*a*3 and 21*a*4 will be opposite to each other. FIG. 4 presents an example wherein the rotors of two motors are connected so that their phases differ from one another in order to eliminate the torque pulsations. As shown here, the rotor 21a3*r* of a motor 21*a*3 and the rotor 21*a*4*r* of a motor 21*a*4 are placed on the output shaft 21*a*c, while their phases are adjusted so that the positions of their magnetic poles differ from one another by an electric angle of 90 degrees. The stators of the motor 21*a*3 and the motor 21*a*4 are of the same structure and placed in corresponding positions (in phase).

In an alternative manner of arranging the plurality of motors in order to reduce the torque pulsations, the rotors may be placed in phase on the output shaft 21*ac*, whereas the stators may be connected so that opposite phases of pulsations appear at a time. Also, both phases of the stators may be adjusted. The same manners of connection as above may also be performed for the motors 21*b*1 and 21*b*2.

Although FIG. 4 takes the motor arrangement of FIG. 3C as an example, the same manners of connection as above may also be performed for the arrangements of FIG. 3A and FIG. 3D.

Figure 5:
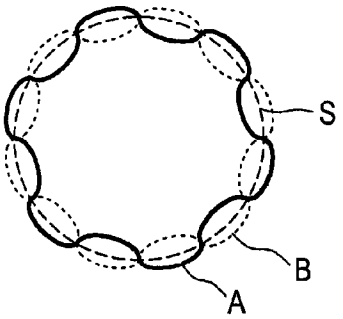
FIG. 5 is a diagram illustrating a torque characteristic when the motors are connected according to the first embodiment of the present invention.

FIG. 5 presents an example wherein, when two motors are connected as described above, how the torques produced by the two motors change depending on rotational positions are represented schematically. In a circumferential direction in FIG. 5, the magnitudes of the toques are plotted. When a same current flows in the motors, this figure represents how the torques of the motors change depending on the rotational positions of the shafts of the motors. A slid line denotes the torque produced by one servo motor 21*a*3 and a dashed line denotes the torque produced by the other servo motor 21*a*4. Although FIG. 5 presents an example wherein 12 pulsations occur in one turn, the number of pulsations, in practice, may vary depending on the structures of the motors used.

The sum of the torques is output to the drive shaft 21*as*. Because the torque pulsations generated by each motor can be cancelled out each other, a torque output with very small torque pulsations can be achieved. A broken line S in FIG. 5 denotes such a torque output (indicating torque which can be produced by one motor corresponding to the sum of the torques produced by the two motors; that is, an average torque by dividing the sum of the torques produced by each motor by two). As can be seen from FIG. 5, the pulsations indicated by the broken line S become very small.

When three motors are connected to a same drive shaft, they are connected so that torque pulsations, substantially, do not appear in the sum of the torques produced by the three motors. That is, when the phases of the rotors connected to the shaft are adjusted as in FIG. 4, they are connected so that the phases of the magnetic poles of the rotors will be separated from one another by an electric angle of 120 degrees. Even if four or more motors are connected, they are connected according to the same principle of connection.

In this manner of connection, a drive system with very small torque pulsations can be realized. This way of connection is suitable for arranging a plurality of motors on a same drive shaft.

Figure 6:
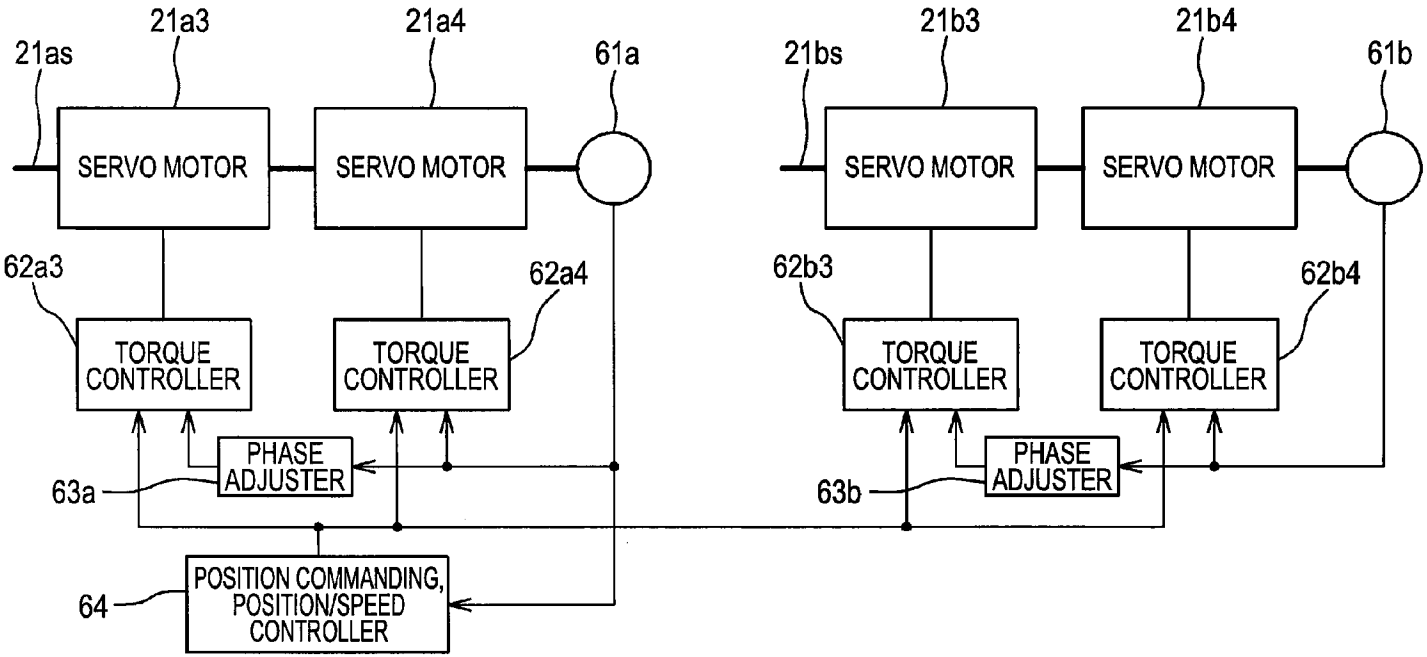
FIG. 6 is a block diagram of a control system according to the first embodiment of the present invention.

FIG. 6 is a block diagram illustrating a configuration example of a control system for servo motors, when two motors are connected as in FIG. 3C and FIG. 4. In FIG. 6, an encoder 61*a* is connected to an end of an output shaft to which the servo motors 21*a*3 and 21*a*4 are connected and an encoder 61*b* is connected to an end of an output shaft to which the servo motors 21*b*3 and 21*b*4 are connected. Rotation signals from the encoder 61*a* are input to a position commanding/position/speed controller 64. The drive shaft 21*as* to which this encoder 61*a* is connected is regarded as a master shaft. The rotational positions and speeds of the servo motors 21*a*3 and 21*a*4, 21*b*3 and 21*b*4, in other words, the position and speed of the slide are controlled.

The position commanding/position/speed controller 64 calculates the rotational positions and speeds of the motors from a slide position command and issues the commands for the rotational positions of the motors in real time. Based on this, the controller 64 controls the rotational positions and speeds of the motors and calculates a torque command for each motor. A same torque command is issued from the position commanding/position/speed controller 64 and input to torque controllers 62*a*3, 62*a*4, 62*b*3, and 62*b*4 which drive the respective motors.

The torque controllers 62*a*3, 62*a*4, 62*b*3, and 62*b*4 have a same structure and each torque controller 62 performs control of a current that flows in each motor, according to the torque command. The torque controller 62 is comprised of a current command generator which generates a current command in accordance with the torque command, a current controller, a PWM controller, a power controller formed of power elements, a current detector which detects a current flowing in the motor, etc. Its detailed structure is well known and, hence, further discussion about it is omitted.

Signals from the encoder 61 are used as those for detecting the positions of the magnetic poles of the respective motors and input to the corresponding torque controllers 62. As illustrated in FIG. 4, two motors connected to a same drive shaft are connected with their phases adjusted to differ from one another. Thus, the magnetic poles of the motors lie in different positions with respect to a rotational position of the drive shaft. Therefore, rotation signals of one motor are phase-adjusted by a phase adjuster 63 and then input to the corresponding torque controller. If each toque controller 62 has a function of coordinating the position of a magnetic pole of the motor with a rotational position from the encoder, the phase adjuster 63 is dispensed with.

The configuration as described above enables a master-slave drive regarding the drive shaft 21*as* as a master shaft and the drive shaft 21*bs* as a slave shaft and enables well-balanced operation in which each motor outputs an even torque. Because motors connected to a same shaft as described above are connected so that their torque pulsations are reduced, a drive with little torque pulsations can be achieved.

As described herein, because two motors are connected to a same shaft, it is not required to attach an encoder to each motor and one encoder should only be attached to a same shaft. It is also possible to provide an encoder for each motor. Rather, according to the method of the present embodiment, the number of encoders is reduced and wiring for detection can be reduced; thereby, a high reliability can be achieved.

In the foregoing description, the connection of motors to a same shaft is performed such that the mechanical phases of the motors themselves are adjusted to differ from one another in order to reduce torque pulsations. Alternatively, reducing torque pulsations can also be done by means of electrical control, instead of connecting the motors to produce the phase difference effect. Specifically, torque pulsations are known by obtaining rotational positions of the motors. Current control may be performed for each of two motors to cancel out mutual pulsations of the motors. At this time, currents to cancel out the torque pulsations of the two motors are not the same; rather, it is effective to cause different currents to flow in the two motors to cancel out the pulsations each other.

If the control system is configured as in FIG. 6, in case of abnormal stop of a controller for a motor, for example, should a fault has occurred in a controller for a servo motor 21*a*3, only the controller for the servo motor 21*a*3 is stopped, while operation can easily be continued only with another normal motor. Because the drive shaft to which the stopped motor is connected is driven by the normal motor, it does not happen that the drive shaft of the stopped motor rotates idly, which would occur in a case where every motor has a drive shaft. Therefore, a drive with a high reliability can be achieved.

The press structure of the present embodiment described above, in which a plurality of motors are placed on a same drive shaft, provides for complete synchronization of the right and left crank structures with the engagement of the main gears and enables a drive with fewer gears. Thus, this press structure provides the following advantages: simple structure; small loss; downscalable; highly-responsive operation with small inertia moment is practicable; impervious to accuracy deterioration due to gear backlash; and less gear duty, as a sum of torques produced by a set of motors is only exerted on each main gear. In addition, reduced torque pulsations yield the advantages of improved accuracy in positioning the slide, high responsiveness, and low noise.

[Second Embodiment]

Figure 7:
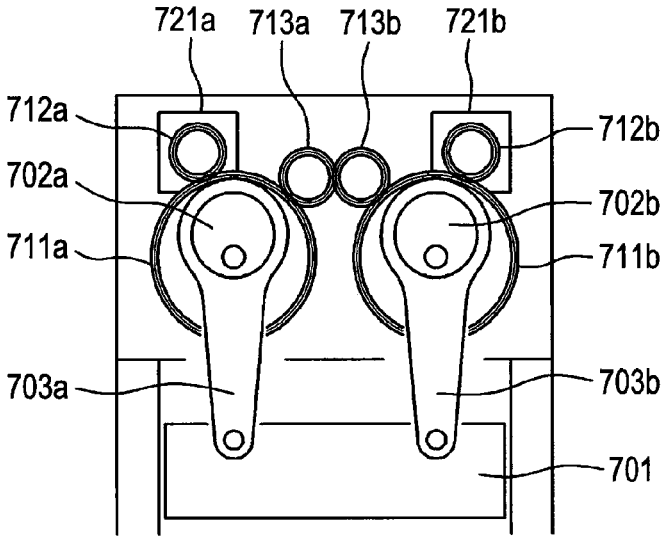
FIG. 7 is a structural diagram of a second embodiment of the present invention.

FIG. 7 is a structural diagram of a second embodiment of the present invention. The second embodiment is characterized in that intermediate gears are added and disposed to the structure of the first embodiment.

An eccentric portion of an eccentric ring 702*a* engages with a hole in a large-diameter portion of a connecting rod 703*a*. A lower end of the connecting rod 703*a* is connected to a slide 701. Moreover, an eccentric portion of an eccentric ring 702*b* engages with a hole in a large-diameter portion of a connecting rod 703*b*. A lower end of the connecting rod 703*b* is connected to the slide 701.

Main gears 711*a*, 711*b* are connected to one ends of the eccentric rings 702*a*, 702*b*, respectively. A main gear 711*a* is meshed with a drive gear 712*a* which connects with a drive shaft of a servo motor set 721*a* and thus connected to the servo motor set 721*a*. Likewise, a main gear 711*b* is meshed with a drive gear 712*b* which connects with a drive shaft of a servo motor set 721*b* and thus connected to the servomotor set 721*b*. Further, the main gear 711*a* is meshed with an intermediate gear 713*a* and the main gear 711*b* is meshed with an intermediate gear 713*b*. The intermediate gears 713*a* and 713*b* are engaged. In this way, the main gears 711*a* and 711*b* are interlinked.

In this way, synchronization of the right and left main gears 711*a* and 711*b* is provided. In the example shown here, the main gears 711*a* and 711*b* rotate in opposite directions to each other. In the servomotor sets 721*a*, 721*b*, a plurality of motors are connected to a same shaft, as will be described later.

FIGS. 8A to 8D present examples of concrete arrangements of servo motors connected. In these figures, gears with the same reference numbers as in FIG. 7 represent identical ones.

Figure 8A:
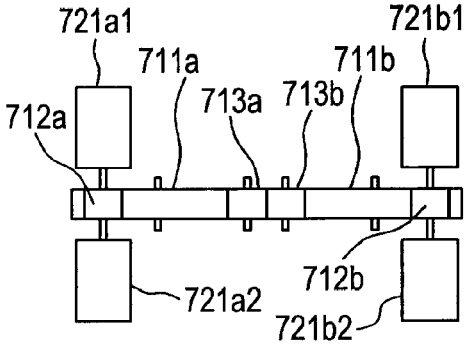
FIGS. 8A, 8B, 8C, and 8D illustrate arrangements of motors according to the second embodiment of the present invention.
Figure 8B:
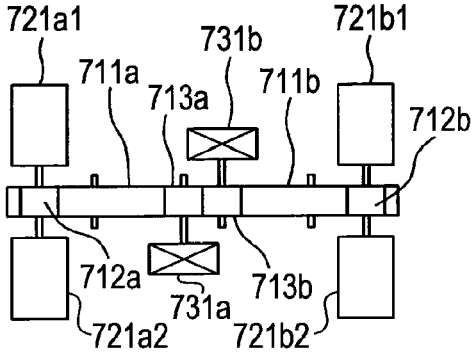
Figure 8C:
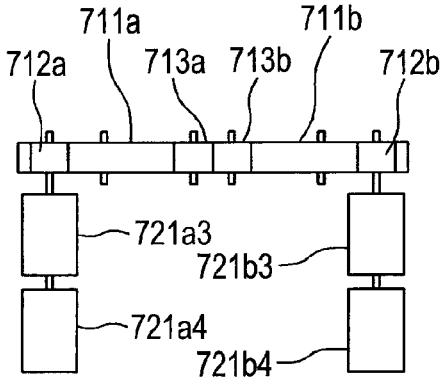

For the servo motor set 721*a* as shown in FIGS. 8A, 8B, and 8C, two servomotors are connected to a same motor drive shaft 721*as*. For the servo motor set 721*b*, two servomotors are connected to a same motor drive shaft 721*bs*. FIGS. 8A and 8B present examples wherein motors are arranged on either side of the drive gears 712*a*, 712*b*. Servomotors 721*a*1, 721*a*2 are connected to the shaft on either side of the drive gear 712*a*, whereas servo motors 721*b*1, 721*b*2 are connected to the shaft on either side of the drive gear 712*b*. A well-balanced drive can be yielded.

Figure 8D:
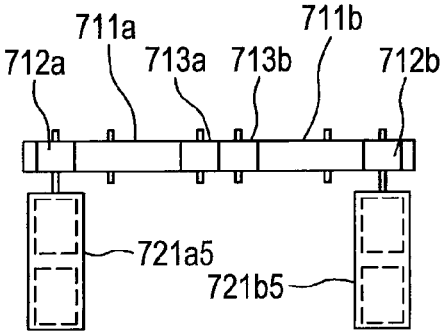

FIG. 8B presents an example wherein mechanical brake devices 731*a*, 731*b* are added and disposed to the motor arrangement of FIG. 8A and connect to the shafts of the intermediate gears 713*a* and 713*b*. The brake devices may be arranged as illustrated with regard to the first embodiment. FIG. 8C presents an example wherein motors 721*a*3, 721*a*4 are arranged on one side of the drive gear 712*a* and motors 721*b*3, 721*b*4 are arranged on one side of the drive gear 712*b* and this arrangement can make the drive shafts of the motors even shorter. FIG. 8D presents an example wherein a stator part and a rotor part (surrounded by broken lines in the figure) of a plurality of motors are contained within a same frame. Motors 21*a*5 and 21*b*5 are arranged in a so-called tandem structure. As shown, each drive gear is apparently driven by a single motor. In such a structure, the motor connections are short and the space for the motors can be made even smaller.

In the second embodiment as well, connection of motors which are placed on a same shaft and control of the motors can be accomplished in the same way as for the first embodiment. Accordingly, a drive with reduced torque pulsations can be achieved.

[Third Embodiment]

Figure 9:
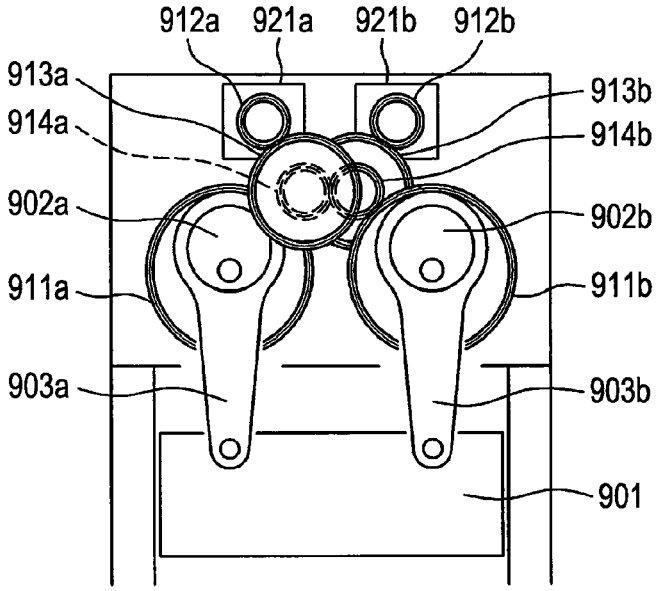
FIG. 9 is a structural diagram of a third embodiment of the present invention.

FIG. 9 is a structural diagram of a third embodiment of the present invention. The third embodiment is characterized in that a two-stage deceleration mechanism by means of intermediate gears is incorporated into the structure of the first embodiment.

An eccentric portion of an eccentric ring 902*a* engages with a hole in a large-diameter portion of a connecting rod 903*a*. A lower end of the connecting rod 903*a* is connected to a slide 901. Moreover, an eccentric portion of an eccentric ring 902*b* engages with a hole in a large-diameter portion of a connecting rod 903*b*. A lower end of the connecting rod 903*b* is connected to the slide 901. Main gears 911*a*, 911*b* are connected to one ends of the eccentric rings 902*a*, 902*b*, respectively.

A main gear 911*a* is meshed with a small intermediate gear 914*a* and a large intermediate gear 913*a* connected with that intermediate gear is meshed with a drive gear 912*a*. The drive gear 912*a* is interlinked with a servo motor set 921*a*. Likewise, a main gear 911*b* is meshed with a small intermediate gear 914*b* and a large intermediate gear 913*b* connected with that intermediate gear is meshed with a drive gear 912*b*. The drive gear 912*b* is interlinked with a servo motor set 921*b*.

Further, the small intermediate gears 914*a* and 914*b* are engaged and, via this engagement, the main gears 911*a* and 911*b* are interlinked. In this way, the right and left main gears 911*a* and 911*b* are synchronized and driven by the servo motor sets 921*a* and 921*b*. In the example shown here, the main gears 911*a* and 911*b* rotate in opposite directions to each other. In the servo motor sets 921*a*, 921*b*, a plurality of motors are connected to a same shaft, as will be described later.

In comparison with the structures of the first and second embodiments, the torques from the motor drive shafts are decelerated in two stages by the intermediate gears and then drive the main gears 911*a*, 911*b*. Therefore, the servo motor sets 921*a*, 921*b* can be run at a higher speed and smaller motors can be put into use. In addition, highly-responsive control can be implemented, because inertial moment as viewed from the motor shafts becomes smaller.

FIGS. 10A, 10B, 10C, and 10D present examples of concrete arrangements of servo motors connected. In these figures, gears with the same reference numbers as in FIG. 9 represent identical ones.

Figure 10A:
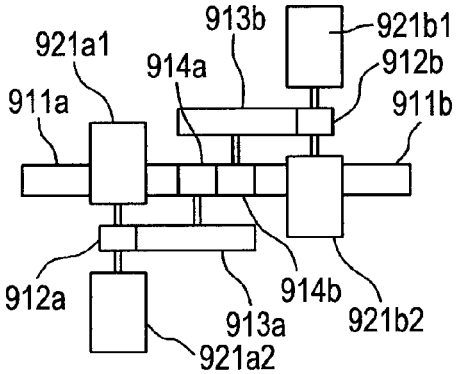
FIGS. 10A, 10B, 10C, and 10D illustrate arrangements of motors according to the third embodiment of the present invention.
Figure 10B:
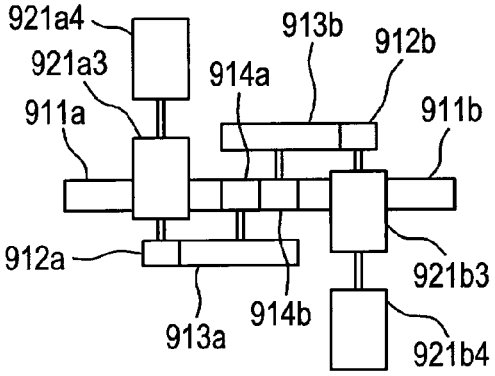
Figure 10C:
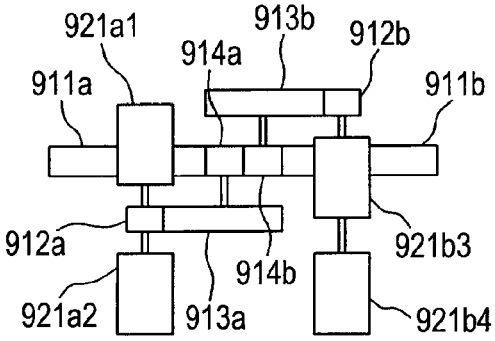

For the servo motor set 921*a* as shown in FIGS. 10A, 10B, and 10C, two servo motors are connected to a same motor drive shaft 921*as*. For the servo motor set 921*b*, two servo motors are connected to a same motor drive shaft 921*bs*. FIG. 10A presents an example wherein motors are arranged on either side of the drive gears 912*a*, 912*b*. Servo motors 921*a*1, 921*a*2 are connected to the shaft on either side of the drive gear 912*a*, whereas servo motors 921*b*1, 921*b*2 are connected to the shaft on either side of the drive gear 912*b*. A well-balanced drive can be yielded.

Figure 10D:
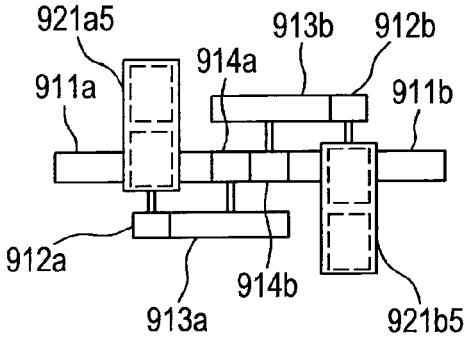

FIG. 10B presents an example wherein motors 921*a*3, 921*a*4 are arranged on one side of the drive gear 912*a* and motors 921*b*3, 921*b*4 are arranged on one side of the drive gear 912*b* and this arrangement can make the drive shafts of the motors even shorter. FIG. 10C presents an example wherein the motor arrangement as in FIG. 10A is adopted in a section where one drive gear is located and the motor arrangement as in FIG. 10B is adopted in a section where another drive gear is located. It is thus possible to shrink the area for arrangement of a whole set of the motors and gears. FIG. 10D presents an example in which a stator part and a rotor part (surrounded by broken lines in the figure) of a plurality of motors are contained within a same frame. Motors 921*a*5 and 921*b*5 are arranged in a so-called tandem structure. As shown, each drive gear is apparently driven by a single motor. In such a structure, the motor connections are short and the space for the motors can be made even smaller.

In the third embodiment as well, connection of motors which are placed on a same shaft and control of all motors can be accomplished in the same way as for the first embodiment. Accordingly, a drive with reduced torque pulsations can be achieved.

[Fourth Embodiment]

Figure 11:
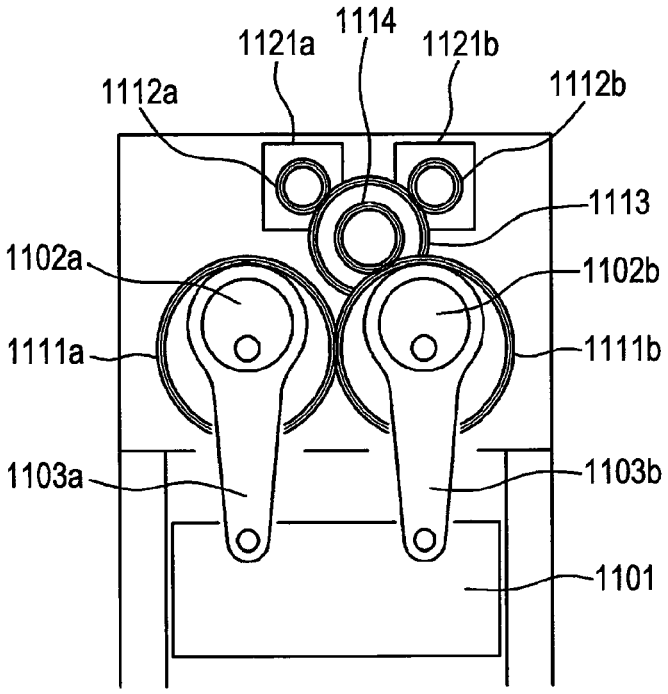
FIG. 11 is a structural diagram of a fourth embodiment of the present invention.

FIG. 11 is a structural diagram of a fourth embodiment of the present invention. The fourth embodiment is characterized in that the main gears are engaged in addition to the two-stage deceleration mechanism adopted as in the structure of the third embodiment.

An eccentric portion of an eccentric ring 1102*a* engages with a hole in a large-diameter portion of a connecting rod 1103*a*. A lower end of the connecting rod 1103*a* is connected to a slide 1101. Moreover, an eccentric portion of an eccentric ring 1102*b* engages with a hole in a large-diameter portion of a connecting rod 1103*b*. A lower end of the connecting rod

1103*b* is connected to the slide 1101. Main gears 1111*a*, 1111*b* are connected to one ends of the eccentric rings 1102*a*, 1102*b*, respectively.

A main gear 1111*b* is meshed with a small intermediate gear 1114 and a large intermediate gear 1113 connected with that intermediate gear is meshed with a drive gear 1112*a* and also with a drive gear 1112*b*. The drive gear 1112*a* is interlinked with a servo motor set 1121*a* via a drive shaft and the drive gear 1112*b* is interlinked with a servo motor set 1121*b* via a drive shaft. The main gear 1111*a* is engaged with the main gear 1111*b*.

In this way, the right and left main gears 1111*a* and 111*b* are synchronized with each other and driven by the servo motor sets 1121*a* and 1121*b*. For the servomotor sets 1121*a* and 1121*b*, a plurality of motors are connected to a same shaft, as is the case for the foregoing embodiments. Concrete arrangements of motors in the servomotor sets 1121*a* and 1121*b* can be made in the same way as presented in the foregoing examples thereof.

In comparison with the third embodiment, because of a smaller number of intermediate gears employed, the torques from the motor drive shafts are decelerated in two stages and transmitted to the main gears 11*a*, 112*b* in a simpler fashion.

In comparison with the structures of the first and second embodiments, the torques from the motor drive shafts are decelerated in two stages by the intermediate gears and then drive the main gears. Therefore, the servo motor sets can be run at a higher speed and smaller motors can be put into use. In addition, highly-responsive control can be implemented, because inertial moment as viewed from the motor shafts becomes smaller.

In the fourth embodiment as well, connection of motors which are placed on a same shaft and control of all motors can be accomplished in the same way as for the first embodiment. Accordingly, a drive with reduced torque pulsations can be achieved.

[Fifth Embodiment]

Figure 12:
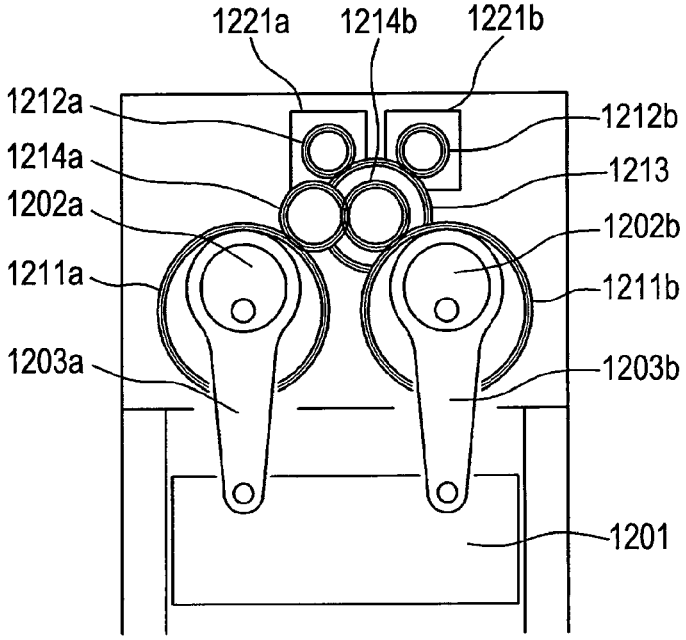
FIG. 12 is a structural diagram of a fifth embodiment of the present invention.

FIG. 12 is a structural diagram of a fifth embodiment of the present invention. The fifth embodiment is characterized in that the two-stage deceleration mechanism is implemented using an additional intermediate gear in the structure of the third embodiment.

An eccentric portion of an eccentric ring 1202*a* engages with a hole in a large-diameter portion of a connecting rod 1203*a*. A lower end of the connecting rod 1203*a* is connected to a slide 1201. Moreover, an eccentric portion of an eccentric ring 1202*b* engages with a hole in a large-diameter portion of a connecting rod 1203*b*. A lower end of the connecting rod 1203*b* is connected to the slide 1201. Main gears 1211*a*, 1211*b* are connected to one ends of the eccentric rings 1202*a*, 1202*b*, respectively.

A main gear 1211*b* is meshed with a small intermediate gear 1214*b* and a large intermediate gear 1213 connected with that intermediate gear is meshed with a drive gear 1212*a* and also with a drive gear 1212*b*. The drive gear 1212*a* is interlinked with a servo motor set 1221*a* via a drive shaft and the drive gear 1212*b* is interlinked with a servo motor set 1221*b* via a drive shaft.

Another main gear 1211*a* is meshed with a small intermediate gear 1214*a* which is in turn meshed with the small intermediate gear 1214*b*. In this way, the right and left main gears 1211*a* and 1211*b* are synchronized with each other and driven by the servo motor sets 1221*a* and 1221*b*. For the servo motor sets 1221*a* and 1221*b*, a plurality of motors are connected to a same shaft, as is the case for the foregoing embodiments. Concrete arrangements of motors in the servo motor sets 1221*a* and 1221*b* can be made in the same way as presented in the foregoing examples thereof.

In comparison with the fourth embodiment, the main gears can be positioned flexibly via the intermediate gear 1214*a*.

In comparison with the structures of the first and second embodiments, the torques from the motor drive shafts are decelerated in two stages by the intermediate gears and then drive the main gears. Therefore, the servo motor sets can be run at a higher speed and smaller motors can be put into use. In addition, highly-responsive control can be implemented, because inertial moment as viewed from the motor shafts becomes smaller.

In the fifth embodiment as well, connection of motors which are placed on a same shaft and control of all motors can be accomplished in the same way as for the first embodiment. Accordingly, a drive with reduced torque pulsations can be achieved.

Needless to say, among the above-described embodiments, those that can be combined with one another may be implemented in combination, as appropriate

What is claimed is:

1. A servo press apparatus comprising:

a slide;

first and second crank structures coupled to the slide;

first and second gear trains interconnected with the first and second crank structures, respectively;

first and second motor shafts connected to the first and second gear trains, respectively;

first and second motor sets each including a plurality of motors, the first motor set having the same rotating axis as that of the first motor shaft, the second motor set having the same rotating axis as that of the second motor shaft so that the first motor shaft is driven by the first motor set and the second motor shaft is driven by the second motor set;

a first encoder coupled to the first motor shaft and configured to detect a rotation position of the first motor shaft;

a second encoder coupled to the second motor shaft and configured to detect a rotation position of the second motor shaft;

a controller configured to receive an output from one of the first and second encoders and a slide position command to calculate a common torque command for the first and second motor sets;

a first phase adjuster configured to adjust an output signal from the first encoder;

a second phase adjuster configured to adjust an output signal from the second encoder;

first torque controllers configured to control currents for the plurality of motors of the first motor set, respectively, based on the common torque command, the output signal from the first encoder and a phase-adjusted output signal of the output signal from the first encoder; and second torque controllers configured to control currents for the plurality of motors of the second motor set, respectively, based on the common torque command, the output signal from the second encoder and a phase-adjusted output signal of the output signal from the second encoder, wherein:

the plurality of motors of the first motor set are placed on the first motor shaft so that phases of the motors of the first motor set are different from each other with respect to an axis of rotation in order to cancel out mutual torque pulsations of the motors of the first motor set, the plurality of motors of the second motor set are placed on the second motor shaft so that phases of the motors of the second motor set are different from each other with respect to an axis of rotation in order to cancel out mutual torque pulsations of the motors of the second motor set, the first torque controllers control the plurality of motors of the first motor set placed on the first motor shaft with different phases based on the phase adjusted output signal from the first phase adjuster and the output signal from the first encoder, the second torque controllers control the plurality of motors of the second motor set placed on the second motor shaft with different phase based on the phase adjusted output signal from the second phase adjuster and the output signal from the second encoder, the first crank structure, the first gear train, the first motor shaft, and the first motor set are arranged symmetrically with the second crank structure, the second gear train, the second motor shaft, and the second motor set, respectively, the first gear train comprises a first main gear and a first drive gear, the second gear train comprises a second main gear and a second drive gear, the first crank structure comprises a first eccentric ring fixed to a rotating axis of the first main gear and a first connecting rod connected between the first eccentric ring and the slide, the first eccentric ring and the first connecting rod converting circular motion of the first main gear into reciprocating motion of the slide, the second crank structure comprises a second eccentric ring fixed to a rotating axis of the second main gear and a second connecting rod connected between the second eccentric ring and the slide, the second eccentric ring and the second connecting rod converting circular motion of the second main gear nto reciprocating motion of the slide, and the first main gear and the second main gear directly engage with each other.

2. The servo press apparatus according to claim 1, further comprising mechanical brakes disposed on one end of the first and second motor shafts, respectively.

3. The servo press apparatus according to claim 1, wherein:

the first motor set includes at least a first motor and a second motor, the first motor and the second motor having the same rotating axis of the first motor shaft, and the second motor set includes at least a third motor and a fourth motor, the third motor and the fourth motor having the same rotating axis of the second motor shaft.

4. The servo press apparatus according to claim 3, wherein:

the first and second motors are respectively placed on different sides of the first motor shaft with respect to the first drive gear, and the third motor and the fourth motor are respectively placed on different sides of the second motor shaft with respect to the second drive gear.

5. The servo press apparatus according to claim 3, wherein:

the first and second motors are placed on the same side of the first motor shaft with respect to the first drive gear, and the third motor and the fourth motor are placed on the same side of the second motor shaft with respect to the second drive gear.

6. The servo press apparatus according to claim 1, wherein:

the plurality of motors of the first motor set are placed on the first motor shaft such that the motors of the first motor set are arranged in a tandem structure in which stator parts and rotor parts of the motors of the first motor set are contained within the same frame; and the plurality of motors of the second motor set are placed on the second motor shaft such that the motors of the second motor set are arranged in a tandem structure in which stator parts and rotor parts of the motors of the second motor set are contained within the same frame.

7. The servo press apparatus according to claim 1, wherein:

one of the first and second motor shafts is a master shaft, one of the encoders coupled to the master shaft is configured to detect a rotation position of the master shaft and to output a position signal, the controller is configured to receive the position signal and to calculate the common torque command based on the received position signal and the slide position command.

8. The servo press apparatus according to claim 7, wherein:

the first motor set includes at least a first motor and a second motor, the first motor and the second motor having the same rotating axis of the first motor shaft, and the second motor set includes at least a third motor and a fourth motor, the third motor and the fourth motor having the same rotating axis of the second motor shaft.

9. The servo press apparatus according to claim 8, wherein:

the first and second motors are placed on different sides of the first motor shaft with respect to the first drive gear, and the third motor and the fourth motor are placed on different sides of the second motor shaft with respect to the second drive gear.

10. The servo press apparatus according to claim 8, wherein:

the first and second motors are placed on the same side of the first motor shaft with respect to the first drive gear, and the third motor and the fourth motor are placed on the same side of the second motor shaft with respect to the second drive gear.

11. A servo press apparatus comprising:

a slide first and second crank structures for moving up and down the slide;

first and second main gears for driving the first and second crank structures, respectively;

first and second drive gears for driving the first and second main gears, respectively;

first and second motor shafts for driving the first and second drive gears, respectively;

first and second motor sets each including a plurality of motors, the plurality of motors of the first motor set being placed on the first motor shaft and the plurality of motors of the second motor set being placed on the second motor shaft so that the first motor shaft is driven by the first motor set and the second motor shaft is driven by the second motor set;

a first encoder coupled to the first motor shaft and configured to detect a rotation position of the first motor shaft;

a second encoder coupled to the second motor shaft and configured to detect a rotation position of the second motor shaft;

a controller configured to receive an output from one of the first and second encoders and a slide position command to calculate a common torque command for the first and second motor sets;

a first phase adjuster configured to adjust an output signal from the first encoder;

a second phase adjuster configured to adjust an output signal from the second encoder;

first torque controllers configured to control currents for the plurality of motors of the first motor set, respectively, based on the common torque command, the output signal from the first encoder and a phase-adjusted output signal of the output signal from the first encoder; and second torque controllers configured to control currents for the plurality of motors of the second motor set, respectively, based on the common torque command, the output signal from the second encoder and a phase-adjusted output signal of the output signal from the second encoder, wherein:

the plurality of motors of the first motor set are placed on the first motor shaft so that phases of the motors of the first motor set are different from each other with respect to an axis of rotation in order to cancel out mutual torque pulsations of the motors of the first motor set, the plurality of motors of the second motor set are placed on the second motor shaft so that phases of the motors of the second motor set are different from each other with respect to an axis of rotation in order to cancel out mutual torque pulsations of the motors of the second motor set, the first torque controllers control the plurality of motors of the first motor set placed on the first motor shaft with different phases based on the phase adjusted output signal from the first phase adjuster and the output signal from the first encoder, and the second torque controllers control the plurality of motors of the second motor set placed on the second motor shaft with different phase based on the phase adjusted output signal from the second phase adjuster and the output signal from the second encoder.

12. The servo press apparatus according to claim 11, wherein one of the first and second motor shafts is a master shaft, and the controller calculates the common torque command based on an output from the first or second encoder coupled to the master shaft.

13. The servo press apparatus according to claim 11, wherein the plurality of motors of the first motor set are placed on different sides of the first motor shaft with respect to the first drive gear, and the plurality of motors of the second motor set are placed on different sides of the second motor shaft with respect to the second drive gear.

14. The servo press apparatus according to claim 11, wherein the plurality of motors of the first motor set are placed on the same side of the first motor shaft with respect to the first drive gear, and the plurality of motors of the second motor set are placed on the same side of the second motor shaft with respect to the second drive gear.

15. The servo press apparatus according to claim 14, wherein the plurality of motors of the first motor set are placed on the first motor shaft such that the motors of the first motor set are arranged in a tandem structure in which stator parts and rotor parts of the motors of the first motor set are contained within the same frame, and the plurality of motors of the second motor set are placed on the second motor shaft such that the motors of the second motor set are arranged in a tandem structure in which stator parts and rotor parts of the motors of the second motor set are contained within the same frame.

* * * * *